US006638699B2

(12) United States Patent
Martin

(10) Patent No.: US 6,638,699 B2
(45) Date of Patent: Oct. 28, 2003

(54) METHOD FOR PROCESSING A COLOR REVERSAL PHOTOGRAPHIC FILM

(75) Inventor: Didier J. Martin, Givry (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/198,492

(22) Filed: Jul. 18, 2002

(65) Prior Publication Data

US 2003/0096201 A1 May 22, 2003

(30) Foreign Application Priority Data

Aug. 6, 2001 (FR) ..... 01 10484

(51) Int. Cl.[7] ..... G03C 7/44
(52) U.S. Cl. ..... 430/398
(58) Field of Search ..... 430/398

(56) References Cited

U.S. PATENT DOCUMENTS 5,607,592 A * 3/1997 Bernard et al. ..... 210/641
5,678,112 A * 10/1997 Bernard et al. ..... 396/565
5,753,424 A 5/1998 Ishikawa ..... 430/463
5,998,108 A * 12/1999 Martin ..... 430/398
6,117,315 A * 9/2000 Masson ..... 210/195.2
6,451,518 B2 * 9/2002 Martin et al. ..... 430/379

FOREIGN PATENT DOCUMENTS

EP 0 204 197 12/1986
EP 0 932 078 A1 7/1999

* cited by examiner

*Primary Examiner*—Hoa van Le

(57) ABSTRACT

The invention relates to a method for processing an exposed color reversal photographic film. This method comprises the step of circulating the exposed film in a fixing bath, in and then a final washing zone comprises at least one washing bath. Each washing bath of this zone comprising a buffer prepared from a weak acid and its conjugated base, with a conjugated base concentration more than 1 g/l, said buffer being chosen to maintain the pH between 4.5 and 6. The method comprises then the step of collecting the contents of the washing baths of this zone and the passage of said contents through a nanofiltration device comprising a membrane, whose cut-off threshold is more than the molar mass of the weak acid and the conjugated base making up the buffer, to give a permeate that is recycled in the final washing zone.

5 Claims, 1 Drawing Sheet

METHOD FOR PROCESSING A COLOR REVERSAL PHOTOGRAPHIC FILM

FIELD OF THE INVENTION

The present invention relates to a process for processing an exposed color reversal photographic film, enabling reduced water consumption and preventing the formation of biofilms resulting from the proliferation of microorganisms in the final washing baths of the processing.

BACKGROUND OF THE INVENTION

For ecological and economic reasons, the reduction of water consumption of processes for processing photographic films is subject to many efforts on the part of the photographic industry. In particular, for processing an exposed color reversal photographic film, it is common to use a final washing zone, comprising several washing baths placed in series. The water for each washing bath is supplied by a counter flow, coming from the bath located downstream, and the replenishment is done in the washing bath furthest from the fixing bath or in the final rinsing bath. However, the retention time for water in this washing zone is increasing, which encourages in these baths the growth of microorganisms (bacteria, yeasts and molds) that develop thanks to the presence of chemical compounds. The presence of these chemical compounds is caused by the carry-over of significant quantities of solutions coming from the processing baths during the passage of the photographic film from tank to tank, either by the photographic film itself, or by the belts used for conveying the photographic film. The proliferation of these microorganisms causes the formation of biofilms increasing the turbidity of the water. This is harmful to the quality of the developed films and maintenance stoppages are required to clean the installations. This problem is more particularly encountered when the washing baths are seasoned, i.e. contaminated by the presence of chemical compounds coming from the baths located upstream in the processing and when the installations are used intermittently as in small photographic processing units or minilabs.

SUMMARY OF THE INVENTION

The present invention provides a method for processing an exposed color reversal photographic film enabling the problems mentioned above to be solved.

The method of the present invention for processing an exposed color reversal photographic film comprises the steps of successively: (1) first black and white developing, the exposed film; (2) subjecting the film developed in (1) to a reversal procedure; (3) color developing; (4) bleaching; (5) fixing and (6) circulating the film after the fixing bath in a final washing zone comprising at least one washing bath, wherein

- at least one washing bath of said final washing zone comprises a buffer, comprised of a weak acid and its conjugated base, with a conjugated base concentration more than or equal to 1 g/l, said buffer being capable to maintain the pH between 4.5 and 6 in said washing bath, and
- after having collected the contents of said washing bath, the said contents are passed through a nanofiltration device, comprising a membrane whose cut-off threshold is more than the molar mass of the weak acid and the conjugated base of the buffer, to give a permeate that is recycled in said final washing zone.

BRIEF DESCRIPTION OF THE DRAWING

The FIG. 1 represents schematically a diagram showing the successive steps of a color reversal processing.

DETAILED DESCRIPTION OF THE INVENTION

Figure 1:
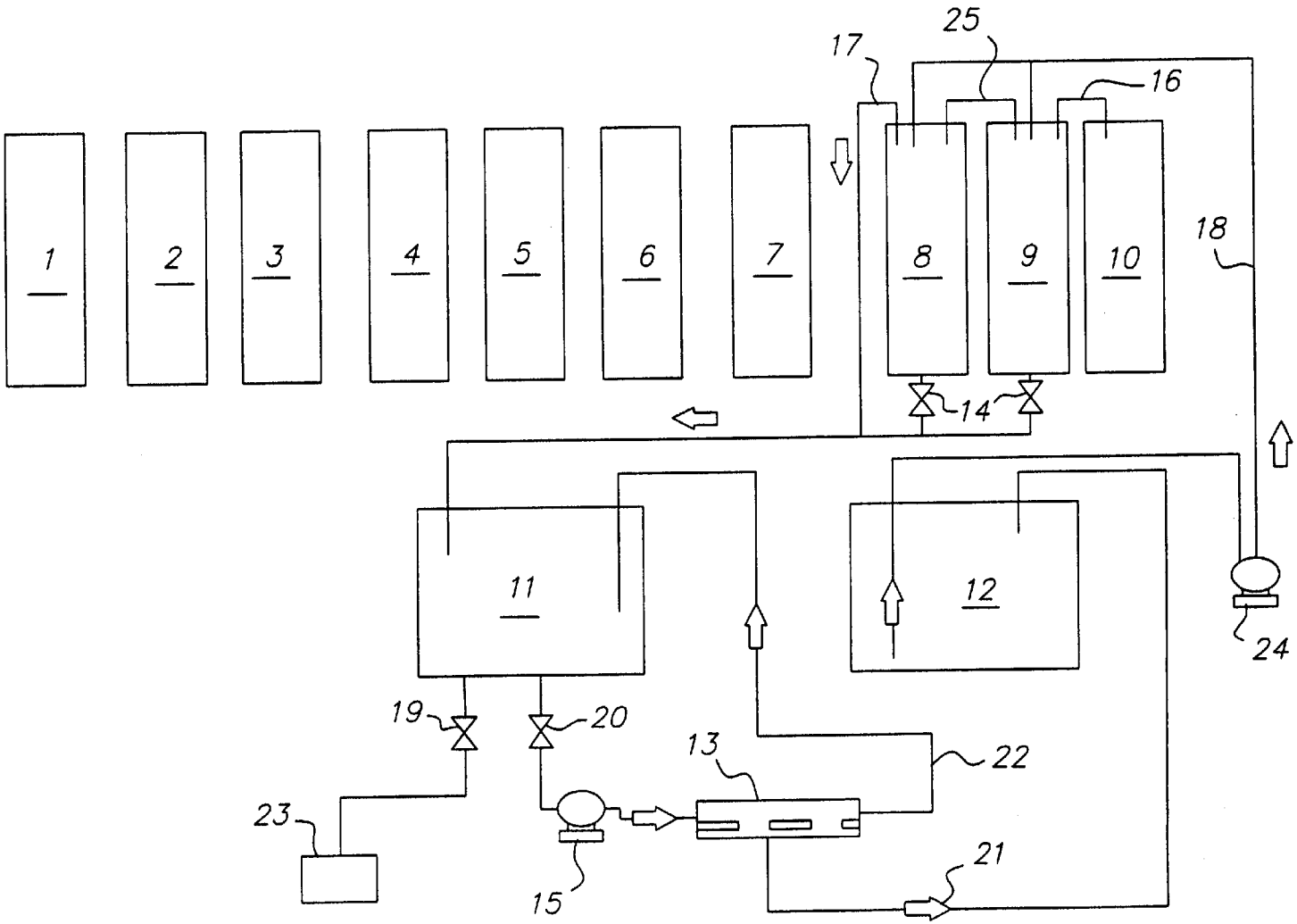

Unexpectedly, it has been discovered that, in color reversal photographic processing, the fact of maintaining in the washing baths, located after the fixing bath, a concentration more than 1 g/l for the conjugated base of the buffer (preferably, an equimolar mixture of weak acid and conjugated base is used), combined with the use of nanofiltration to treat washing baths, enables the prevention of biofilm formation, sources of turbidity for the water of the washing baths and maintenance stoppages to clean the installations. In addition, the process according to the invention does not cause any degradation of the sensitometry of the developed films.

The use of nanofiltration enables a significant reduction in the washing baths of the concentration of chemical compounds, coming from the baths placed upstream in the processing. Thus, nanofiltration enables the removal of the chemical compounds that are used as nutriments by these microorganisms. In addition, nanofiltration enables the advantageous reduction of the water consumption for the processing.

The buffer enables the maintenance of the washing bath in a pH zone unfavorable to the growth of these microorganisms that prefer growth media whose pH is neutral. The washing bath buffer is to be chosen so that it can go through a nanofiltration membrane and produce a buffer effect in the pH range required. To go through a nanofiltration membrane, the components of the buffer agent are not chosen from among multivalent salts and have molecular weights less than the nanofiltration membrane's cut-off threshold. The nanofiltration membrane's cut-off threshold is the molecular weight of the smallest chemical entity selected by the membrane for a retention rate of 0.9.

The retention rate (TR) for a membrane is defined by the equation:

$$TR=1-(C_p/C_r).$$

where $C_r$ is the concentration of the species to be retained in the retentate and $C_p$ is the concentration of the same species in the permeate.

The buffer agent satisfying these conditions is comprised of a weak acid and its conjugated base that is a monovalent salt, these components having a molecular weight less than the nanofiltration membrane's cut-off threshold. Examples of useful buffers enabling the maintenance of the pH of baths in the final zone between 4.5 and 6 are combination of acetic acid with an acetate or combination of propionic acid with a propionate. The acetate or propionate salt can be an alkali metal salt such as a sodium salt. The buffer (weak acid/conjugated base pair) can also be generated in situ by the addition of a base (generally an alkali such as sodium hydroxide) to a weak acid to generate a mixture comprising the weak acid and its conjugated base. Preferably, the concentration of the conjugated base is between 1 g/l and 10 g/l and more preferably between 1 g/l and 2 g/l. In addition, to obtain optimum efficiency of the buffer, those skilled in the art will adjust the concentrations of the weak acid and its conjugated base to obtain an equimolar mixture.

The processing processes for exposed color reversal photographic film are well known and such processes are described in detail in "Chimie et Physique Photographiques" by P. Glafkidès, vol. 2, 5$^{th}$ edition (1987), Chapter XL, pp 947–967.

An example of such a color reversal film processing is the Ektachrome E-6® processing described in detail on page 954 of the above-mentioned handbook.

During the Ektachrome E-6® photographic processing, the photographic film goes successively through each of the following baths:

a) a black and white development bath, b) a first washing bath, c) a chemical reversal bath, d) a color development bath, e) a conditioning bath, e) a bleaching bath, f) a fixing bath, g) one or more washing baths, and h) a rinsing bath.

Then, one proceeds to a drying step.

Similarly, to limit the water consumption of minilabs for processing color reversal photographic films, it is common to maintain in the final washing zone the water level of each of the washing baths placed in series, by a back flow coming from the bath placed downstream and refresh the circuit by the renewal of the washing bath the furthest from the fixing bath or by the renewal of the final rinsing bath.

The temperature of the final washing baths is generally between 15° C. and 45° C. For example, for Ektachrome E-6® processing the temperature of the final washing baths is between 35° C. and 40° C. The final rinsing bath can contain additives such as, for example, chelating agents or biocides. Examples of additives are given in the article published in Research Disclosure, September 1996, Chapter XX, paragraph D: "Washing, rinsing and stabilizing", page 638. The water from washing baths placed after the fix overflow of the washing bath located immediately after the fixing bath and/or by draining the baths of the final washing zone.

The nanofiltration technique used according to the invention requires membranes to separate dissolved substances or chemical products from diluted solutions. Nanofiltration is a technique used to selectively separate salts and organic compounds in solution. Membranes used for nanofiltration thus behave like large surface area sieves having pores of microscopic or molecular size whose dimensions must be very even in order that molecules of a defined size are retained while smaller molecules or ions of simple salts go through the membrane. Membranes for nanofiltration generally let through molecules whose molecular weight is between 100 and 1000 Dalton. Multivalent ionized salts and non-ionized organic compounds with molar mass more than 1000 Dalton are, however, strongly retained.

The solution that has crossed the membrane is called filtrate or permeate and the solution that is retained by the membrane is called concentrate or retentate.

Nanofiltration membranes can be inorganic or organic. Organic membranes are membranes based on cellulose acetate, poly(amide/imide), polysulfone, acrylic polymers or fluoropolymers. Inorganic membranes are membranes based on carbon, ceramics, anodized aluminum, sintered metal or porous glass, or even woven composites based on carbon fibers.

According to the present invention, the nanofiltration membrane is to be chosen so that the membrane's cut-off threshold is more than the molar mass of the components of the buffer used in the washing baths located after the fixing bath. Nanofiltration membranes that are useful according to the invention have a cut-off threshold between 100 and 1000 Dalton, preferably between 150 and 500 Dalton.

Those skilled in the art will determine readily the treatment flow and applied pressure appropriately according to the nanofiltration device chosen. The applied pressure is chosen between 5 bars and 40 bars and preferably between 10 bars and 20 bars.

An example of a nanofiltration membrane that is useful according to the invention, is the NF45 FILMTEC® membrane, NF70 FILMTEC® membrane sold by Dow Europe Separation Systems®, Osmonics DK® membrane, Osmonics MX® membrane, or Osmonics SV® membrane sold by Osmonics.

In the description that follows, reference will be made to the single Figure of the drawing that schematically represents a preferred embodiment of the process according to the invention.

The film to be developed (not shown) is taken to a black and white development bath (1) from whose output this film goes to a first washing bath (2). The film is then taken to the reversal bath (3). It then passes into a color development bath (4), a conditioning bath (5), a bleaching bath (6), a fixing bath (7) and into a final washing zone including the baths (8) and (9) comprising a buffer, prepared from a weak acid and its conjugated base, with a conjugated base concentration more than or equal to 1 g/l, said buffer being capable of passing through a nanofiltration membrane and is chosen to maintain the pH between 4.5 and 6 in these washing baths. The film then passes into a final rinsing bath (10) before being dried. The levels of the washing baths (8) and (9) are maintained by the backflows (16) and (25), while the final rinsing bath (10) is renewed (the renewal rate being set in relation to the surface area of processed film). The renewal circuit of baths (1), (3), (4), (5), (6), (7) and (10) are not shown. The rinsing bath (10) can contain surface actives, chelating agents, biocides as well as other conventional additives for rinsing baths.

The wastewater of the washing baths (8) and (9) are collected into a tank (11), either by means of the overflows (17), or by means of drain valves (14). From the tank (11), the collected wastewater is taken through a nanofiltration membrane device (13) by opening the valve (20) and using a high-pressure pump (15). The retentate (22) from the nanofiltration device (13) can be either evacuated from the circuit, for example to an auxiliary treatment device (not shown), or recycled in the tank (11). The permeate (21) can supply either an auxiliary source (12) (option shown on the diagram), or directly the washing baths (8) and (9) (option not shown on the diagram).

Parts (not shown) can be added, such as, for example, conductivity meter measuring devices for the concentrations of the chemical species of the solution in the tank (11), with servo control enabling evacuation of part of the contents of this tank when these concentrations reach or exceed a certain limit, to an auxiliary treatment device (23). For example, a valve (19) can be provided to enable this evacuation. The changes of the pH can also be monitored in this tank (11) by conventional techniques, for example with a pH-meter.

The permeate (21) coming from the nanofiltration device (13) can be collected in an auxiliary source (12) that by means of a pump (24) and a channel system (18) enables the renewal of the washing baths (8) and (9) with water containing the buffer which has not been retained by the nanofiltration device (13).

This embodiment is especially advantageous because it enables the prevention of biofilm formation in the washing baths (8) and (9) while significantly reducing the water consumption of the washing baths located after the fixing bath and without deterioration of the sensitometry of the developed films.

The invention is described in detail in the following examples.

EXAMPLE

Example 1

A Noritsu QSF-R4103 E6 minilab marketed by the Noritsu company is used. The minilab uses the following sequence:

| E-6 baths | Duration | Temperature ° C. | Service rate |
|---|---|---|---|
| 1st development (1) | 6 m | 38 | 2150 ml/m$^2$ |
| 1st washing (2) | 2 m 30 s | 35 | 1075 ml/m$^2$ coming from a backflow from the reversal bath (3) |
| Reversal bath (3) | 2 m 30 s | 38 | 1075 ml/m$^2$ |
| Color development (4) | 6 m | 38 | 2150 ml/m$^2$ |
| Conditioner (5) | 2 m 30 s | 38 | 1075 ml/m$^2$ |
| Bleaching (6) | 6 m | 40 | 230 ml/m$^2$ |
| Fixing (7) | 2 m 30 s | 38 | 1075 ml/m$^2$ |
| Final washing (8) | 2 m 30 s | 37–38 | backflow (25) |
| Final washing (9) | 2 m 30 s | 37–38 | backflow (16) |
| Final rinsing (10) | 2 m 30 s | 30–34 | 2150 ml/m$^2$ |

Exposed films are developed in this minilab, KODAK ELITECHROME 100® (5 rolls/day for 6 days) and KODAK EKTACHROME Plus® (5 rolls/day for 6 days), using the Ektachrome E-6® process.

The water from the washing baths (8) and (9) is treated daily using a nanofiltration filtration membrane NF45 FILMTEC® having a specific treatment surface area of 2.21 m$^2$, marketed by Dow Europe Separation Systems®, with a supply flow rate of 600 l/h at a pressure of 20 bars. The recycling rate of the collected water is 97–98%. The membrane's retention rate for acetate ions is 15%. For the test according to the invention the acetate concentration is maintained at a value more than 1 g/l by the addition of an acetic acid/sodium acetate buffer in the washing baths (8) and (9), while for the comparative test we make no extra addition of buffer.

Then after six days use, the minilab is left idle for 72 hours (maintenance stop simulation). After this period, the presence or not of biofilms is noted and the acetate concentration is measured by the capillary zone electrophoresis technique (CZE), as well as the pH in the final washing baths (8) and (9). The results are given in Table 1.

TABLE 1

| | | Before 72 hr stop | | After 72 hr stop | |
|---|---|---|---|---|---|
| | | pH | [acetate] g/l biofilm presence | pH | [acetate] g/l biofilm presence |
| Comparison | Washing bath (8) | 6.69 | 0.86 no | 8.21 | 0.46 yes if in colloidal form |
| | Washing bath (9) | 6.23 | 0.90 no | 8.59 | 0.40 yes if in colloidal form |
| Invention | Washing bath (8) | 5.7 | 1.39 no | 5.7 | 1.38 no |
| | Washing bath (9) | 5.7 | 1.39 no | 5.7 | 1.37 no |

Then, the operation is continued conventionally by the drying operation. (Temperature>67° C.).

A concentrated buffer solution (a) is prepared containing:

NaOH, 50% (24 g), deionized water (48 g), acetic acid (42.7 g).

The final washing baths (8) and (9) are prepared in the following way:

3 ml of the buffer solution (a) are diluted per liter of water to obtain a sodium acetate concentration of 1.38 g/l.

The final rinsing bath (10) is prepared in the following way:

3 ml of the buffer solution (a) are mixed with 7.5 ml of a solution (b) coming from the Kodak Servicing Final Rinsing E-6 AR, MX 1770® (supplied by Eastman Kodak, catalogue N° 5247010) per liter of water. Concentrations of sodium acetate and acetic acid of 1.39 g/l and 1.15 g/l respectively are obtained. This bath is renewed with the same solution at a rate of 2150 ml/m$^2$.

Monitoring of the processing quality is carried out using control strips, catalogued under the name "Kodak Control Strips, Process E-6 (emulsion 9041)" supplied by the KODAK company. The control strip measurements are then compared with a reference, representing the optimum operating characteristics for Ektachrome E-6 processing. These control strips are used according to the manual "Process E-6 using Kodak chemicals", Chapter 13, N°Z-119 published by Kodak (October 1997).

For the comparative test, after the 72-hour stop, the control strip shows that the sensitometric quality of the developed films is no longer acceptable, while the test according to the invention shows a control strip that stays within the required standards.

Note that the fact of maintaining the sodium acetate concentration at a value more than 1 g/l in the final washing baths (8) and (9), combined with the use of nanofiltration, enables the prevention of biofilm formation in these washing baths and the maintenance of the pH in the optimum value zones for processing. In addition, the process according to the invention enables reduction of processing water consumption (the recycling rate of the collected water is 97–98%).

The invention has been described in detail with particular reference to certain preferred embodiments thereof, but it will be understood that variations and modifications can be effected within the spirit and scope of the invention.

What is claimed is:

1. A method for processing an exposed color reversal photographic film comprising the steps of successively: (1) black and white developing the exposed film; (2) subjecting the film to a reversal procedure; (3) color developing; (4) bleaching; (5) fixing and (6) circulating this film after the fix in a final washing zone comprising at least one washing bath, wherein:

the at least one washing bath of said final washing zone comprises a buffer, comprised of a weak acid and its conjugated base, with a conjugated base concentration more than or equal to 1 g/l, said buffer being capable to maintain the pH in the range of from 4.5 to 6 in said washing bath, and after having collected the contents of said washing bath, the said contents are passed through a nanofiltration device, comprising a membrane whose cut-off is more than the molar mass of the weak acid and the conjugated base making up the buffer, to give a permeate that is recycled in said final washing zone.

2. The method of claim 1, wherein the concentration of said conjugated base is in the range from 1 g/l to 10 g/l.

3. The method of claim 1, wherein the concentration of said conjugated base is in the range from 1 g/l to 2 g/l.

4. The method of claim 1, wherein said buffer comprises an equimolar mixture of said weak acid and its conjugated base.

5. The method of claim 1, wherein said buffer is either the combination of acetic acid with an acetate or the combination of propionic acid with a propionate.

* * * * *